US006510953B2

(12) United States Patent
Daniels

(10) Patent No.: US 6,510,953 B2
(45) Date of Patent: Jan. 28, 2003

(54) RACK FOR REMOVABLY HOLDING RODS

(76) Inventor: James C. Daniels, 4145 Mapleridge, Grapevine, TX (US) 76051

( * ) Notice: Subject to any disclaimer, the term of this patent is extended or adjusted under 35 U.S.C. 154(b) by 0 days.

(21) Appl. No.: 09/850,246

(22) Filed: May 7, 2001

(65) Prior Publication Data

US 2002/0162811 A1 Nov. 7, 2002

(51) Int. Cl.[7] ..... A47F 5/00
(52) U.S. Cl. ..... 211/60.1; 211/70.8; 211/89.01
(58) Field of Search ..... 211/70.8, 60.1, 211/70, 68, 89.01

(56) References Cited

U.S. PATENT DOCUMENTS

| | | | | |
|---|---|---|---|---|
| 350,523 | A | * | 10/1886 | Bodley |
| 1,240,705 | A | | 9/1917 | Grode |
| 1,706,683 | A | * | 3/1929 | Victorsohn |
| 1,719,360 | A | | 7/1929 | Deike |
| 1,894,167 | A | | 1/1933 | Doht |
| 2,797,851 | A | * | 7/1957 | Leake |
| 3,537,595 | A | | 11/1970 | Mathisen et al. |
| 3,876,076 | A | | 4/1975 | Hazelburst |
| 3,995,742 | A | | 12/1976 | Austin et al. |
| 4,132,381 | A | | 1/1979 | McClellan |
| 4,310,094 | A | | 1/1982 | Hotchkiss, Jr. |
| D272,787 | S | | 2/1984 | Rumbaugh |
| D275,534 | S | | 9/1984 | Halverson |
| 4,796,762 | A | | 1/1989 | Law |
| 4,961,505 | A | | 10/1990 | Moeller |
| 4,986,427 | A | | 1/1991 | Law et al. |
| 5,487,475 | A | | 1/1996 | Knee |
| 5,738,229 | A | * | 4/1998 | Fair Weather ..... 211/70.2 |

* cited by examiner

*Primary Examiner*—Robert W. Gibson, Jr.
(74) *Attorney, Agent, or Firm*—Arthur F Zobal

(57) ABSTRACT

The rack is formed by spaced apart upper and lower rack members with a plurality of spaced apart slots formed in the upper member from a front edge and a plurality of spaced apart apertures formed in the lower member with each aperture aligned with a portion of an associated slot. Each slot has an entrance leading to a neck which extends to a bend. The bend leads to a closed end spaced inward from the upper member edge and which is located laterally from the entrance with the distance between the upper member front edge and the closed end being less that the distance between the upper member front edge and the bend. An elastic cord extends across the neck of each slot inward from and parallel to the edge of the upper member at about the position of the closed ends of the slots.

10 Claims, 5 Drawing Sheets

RACK FOR REMOVABLY HOLDING RODS

BACKGROUND OF THE INVENTION

1. Field of the Invention

The invention relates to a rack for removably holding rods such as fishing rods, pool cues, etc.

2. Description of the Prior Art

There are a number of different types of racks for holding rods such as fishing rods, pool cues, etc. Examples of these racks are found in the following U.S. Pat. Nos.; D272,787; D275,534; 1,240,705; 1,719,360; 1,894,164; 3,537,595; 3,876,076; 3,995,742; 4,132,381; 4,310,094; 4,796,762; 4,961,505; 4,986,427; and 5,487,475.

SUMMARY OF THE INVENTION

It is an object of the invention to provide a unique and useful rack for holding rods such as fishing rods, pool cues, etc.

The rack comprises two rack members one of which has a slot formed in its edge. The slot has an entrance leading to a closed end by way of a bend. The closed end defines a receiving space. An elastic cord extends along said one rack member and crosses the slot between the entrance and the bend and which normally extends to a position near the closed end. The other rack member has an aperture formed therethrough which is in alignment with the closed end receiving space. A rod may be placed in the rack by locating one end in the aperture and moving the rod portion at the level of the slot into the slot and against the resistance of the cord around the bend and into the holding space of the closed end.

In the embodiment disclosed, the slot portion between the entrance and the bend and the slot portion between the closed end and the bend define an acute angle.

In the preferred embodiment, the edges of the slot portion between the closed end and the bend define an angle of about 22.5 degrees.

DESCRIPTION OF THE PREFERRED EMBODIMENTS

Figure 1:
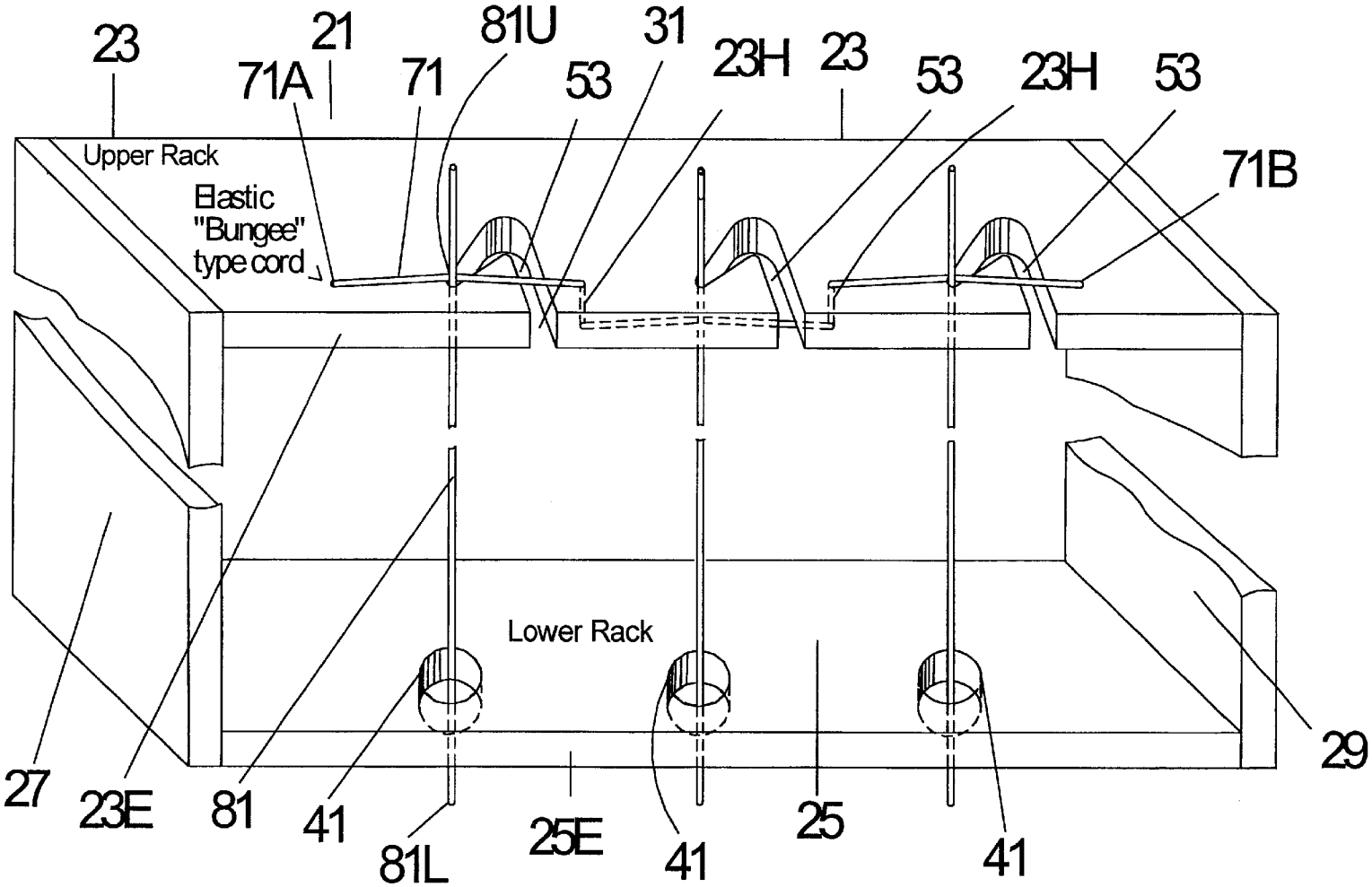
FIG. 1 is an isometric view of the rack of the invention.
Figure 3:
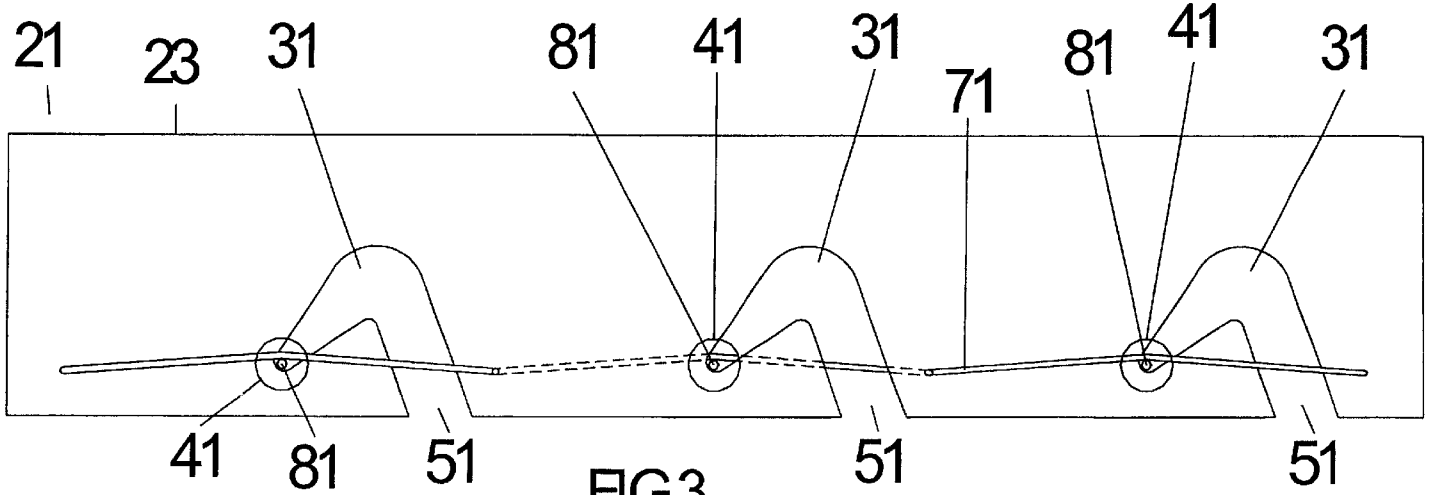
FIG. 3 is a top plan view of the rack of the FIG. 3 with three rods held by the rack.
Figure 2:
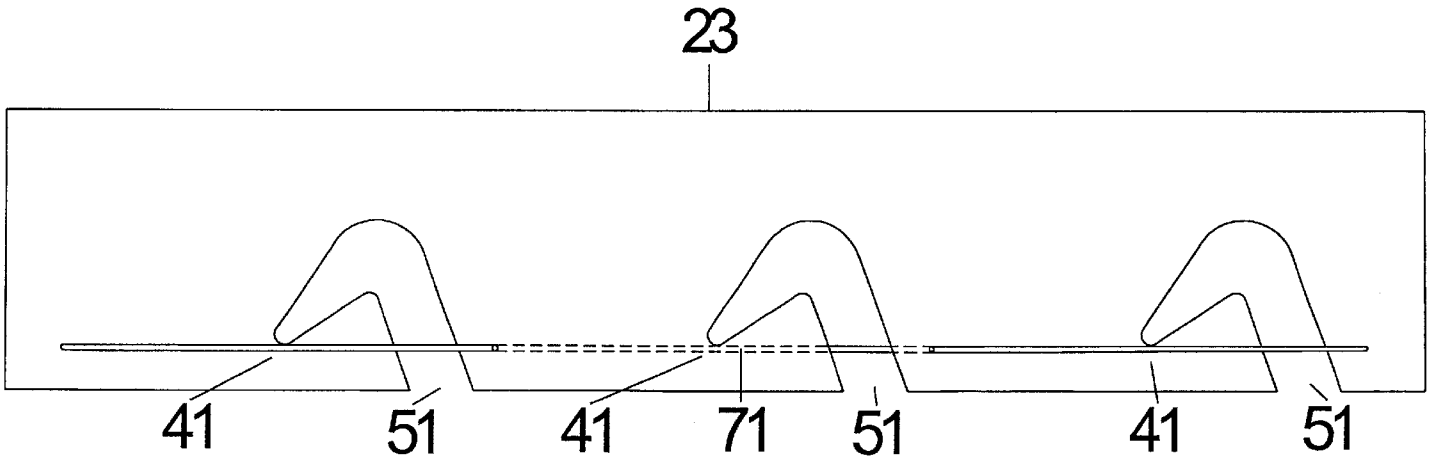
FIG. 2 is a top plan view of the rack of FIG. 1 without any rods held by the rack.

Referring now to the drawing, the rack of the invention is identified at 21. It comprises an upper rack member 23, and a lower rack member 25 both of which are connected to two side walls 27 and 29 shown in broken form. The walls 27 and 29 will have a height sufficient to accept rods such as fishing rods, pool cues, etc. Although not shown, the rack 21 may have a rear wall.

Three spaced apart slots 31 are shown formed through the upper member 23 from its front edge 23E. Three apertures

41 are formed through the lower member 25 at positions spaced inward from its front edge 25E in alignment with a portion of each slot such that the rack 21 may hold three rods. It is to be understood that the members 23 and 25 may be longer such that more than three slot-aperture pairs 31, 41 may be formed through the members 23 and 25 to hold more rods.

Each slot 31 comprises an entrance 51 leading to a neck 53 having two parallel spaced apart walls 53A and 53B which extend to a bend 55 having two curved spaced apart walls 55A and 55B which lead to a triangular shaped end portion 57 defined by two straight walls 57A and 57B which converge to a curved closed end wall 59 which defines a rod holding space 61. In the preferred embodiment, angles Ø are each equal to 70 degrees and walls 57A and 57B define an angle $\alpha$ which is equal to 22.5 degrees. The closed end wall 59 is spaced inward from the edge 51E and is located along a line 63 perpendicular to the edge 41E which line 63 is spaced laterally from the entrance edge 51A. The closed end wall 59 also is located closer to the edge 23E than any portion of the bend 55 and its curved wall 55A. For use for holding fishing rods, D1 is equal to ¾ of an inch; D2 is equal to 2⅛ inches; D3 is equal to ⅞ of an inch; D4 is equal to 2.5 inches; D5 is equal to ⅝ of an inch; D6 is equal to 5.5 inches; D7 is equal to ½ of an inch; D8 is equal to 1⅜ of an inch; and D9 is equal to ¼ of an inch. The radius of the curved closed end wall 59 may be of the order of ⅛ of an inch. The radius of the curved wall 55B of the bend 55 is of the order of ½ of an inch. The aperture 41 located below each curved end wall 59 may have a radius of ⅝ of an inch and the center of each curved end wall 59 is aligned with the center of its associated lower aperture 41. A straight line bisecting the neck 53 between walls 52A and 53B and a straight line bisecting 57 between the walls 57A and 57B define an acute angle.

Figure 4:
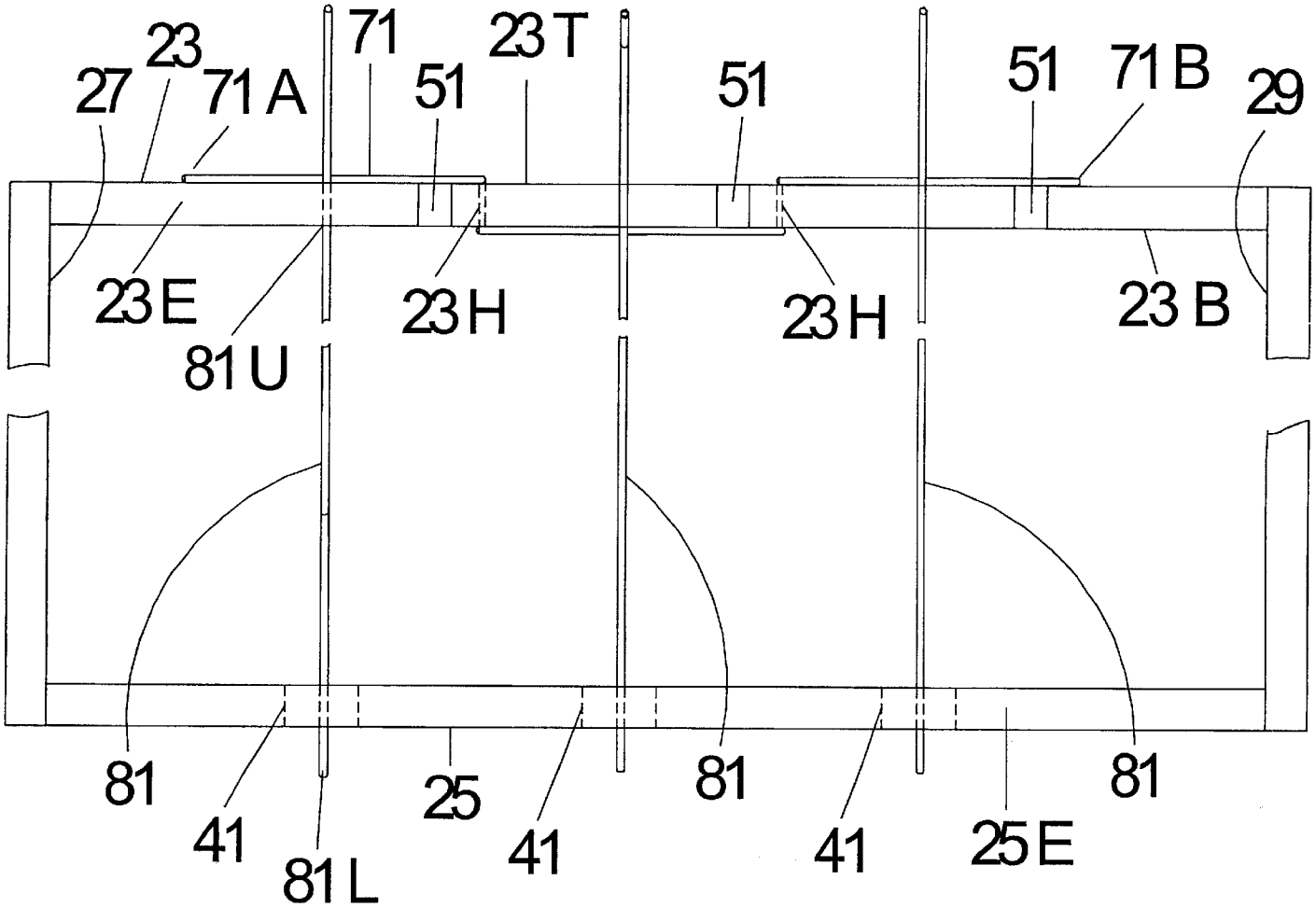
FIG. 4 is a front plan view of the rack of FIG. 1 with three rods held by the rack.
Figure 5:
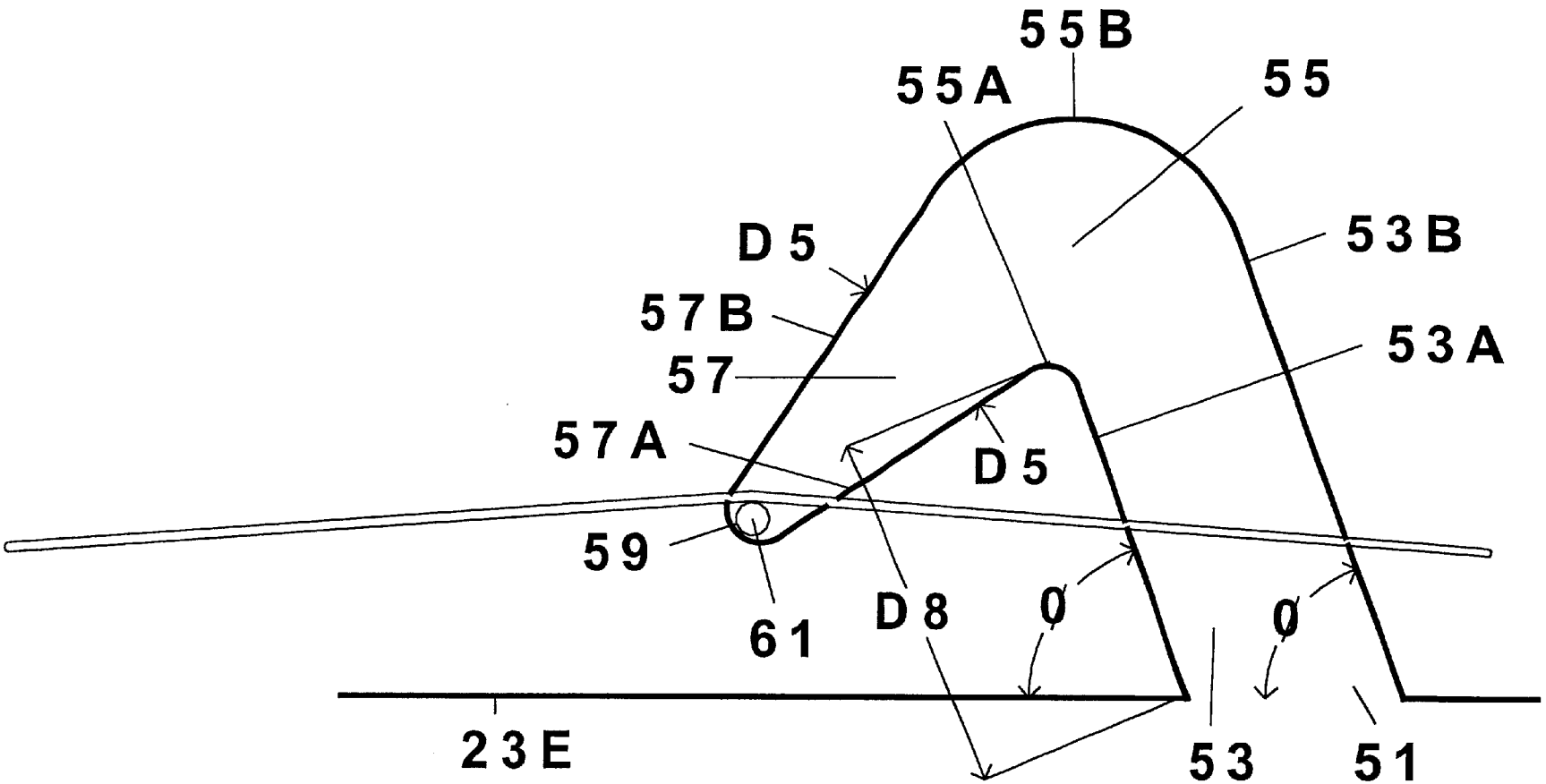
FIG. 5 is a top plan view of one of the slots of the rack of the invention.

Extending across the neck 53 of each slot 31 at position near its closed end wall 59 and spaced inward from the edge 23E is an elastic cord 71 such as a bungee cord. With no rod 81 in place, the cord 71 normally is located about ½ of an inch from the edge 23E. In the preferred embodiment, the same cord 71 extends across each neck 53 of each slot 31 and extends across adjacent necks 53 on the top side 23T and bottom side 23B of the member 23. In the embodiment shown, apertures 23H extend through the member 23 on opposite sides of the middle slot 31. See FIG. 4. The cord 71 has an end 71A secured to the top side of the member 23 on the left of the left slot 31 shown. The cord 71 extends across the neck 53 above the left slot 31, down through the first aperture 23H across the neck 53 below the next slot 31, upward through the next aperture 23H, across the neck 53 above the last slot 31 and its end 71B is secured to the top side 23T of the member 23.

In locating a rod 81 in a slot/aperture pair 31/41 of the rack 21, its lower end 81L is inserted through an aperture 41 and the upper end portion 8 1U is located in the slot 31 by locating it in the entrance 51, moving it in the neck 53 against the resistance o the cord 71, counter-clockwise around the bend 55 and then in the closed end 59 receiving portion 61. This causes the cord 71 to be moved inward as the rod portion 81U is moved around the bend and when the rod portion 81U is located in the zone 61 of the closed end portion 59, the cord 71 holds the rod portion 81U against the wall 59 and removably secures the rod 81 in the slot 31 and aperture 41.

In order to remove the rod 81 from the rack, the upper portion 81U is moved clockwise around the bend 55 against the resistance of the cord 71, into the neck 53 and out of the entrance 51 and the rod 81 then is removed from the aperture 41.

The rods 81 illustrated are shown in broken form. The apertures 41 and the slots 31 may have different dimensions than those set forth above suitable to receive and hold rods of different diameters or size. Normally the apertures 41 will have radii greater than the radii of the closed portions 59.

The slots 31, apertures 41 and cord 71 are effective in removably holding rods to the rack when the rack is supported in many places such as on the floor, or hung on a wall or even on a ceiling of a house. The rack may be mounted to hold the rods either vertically or horizontally.

Although the slots 31 are shown formed in the member 23 with the closed ends 59 on the left of the necks 53, it is to be understood that these positions may be reversed such that the closed ends 59 are on the right of the necks 53. In this case the apertures 41 will be located to the right of the slots such that they are aligned with the holding portions 61.

Figure 6:
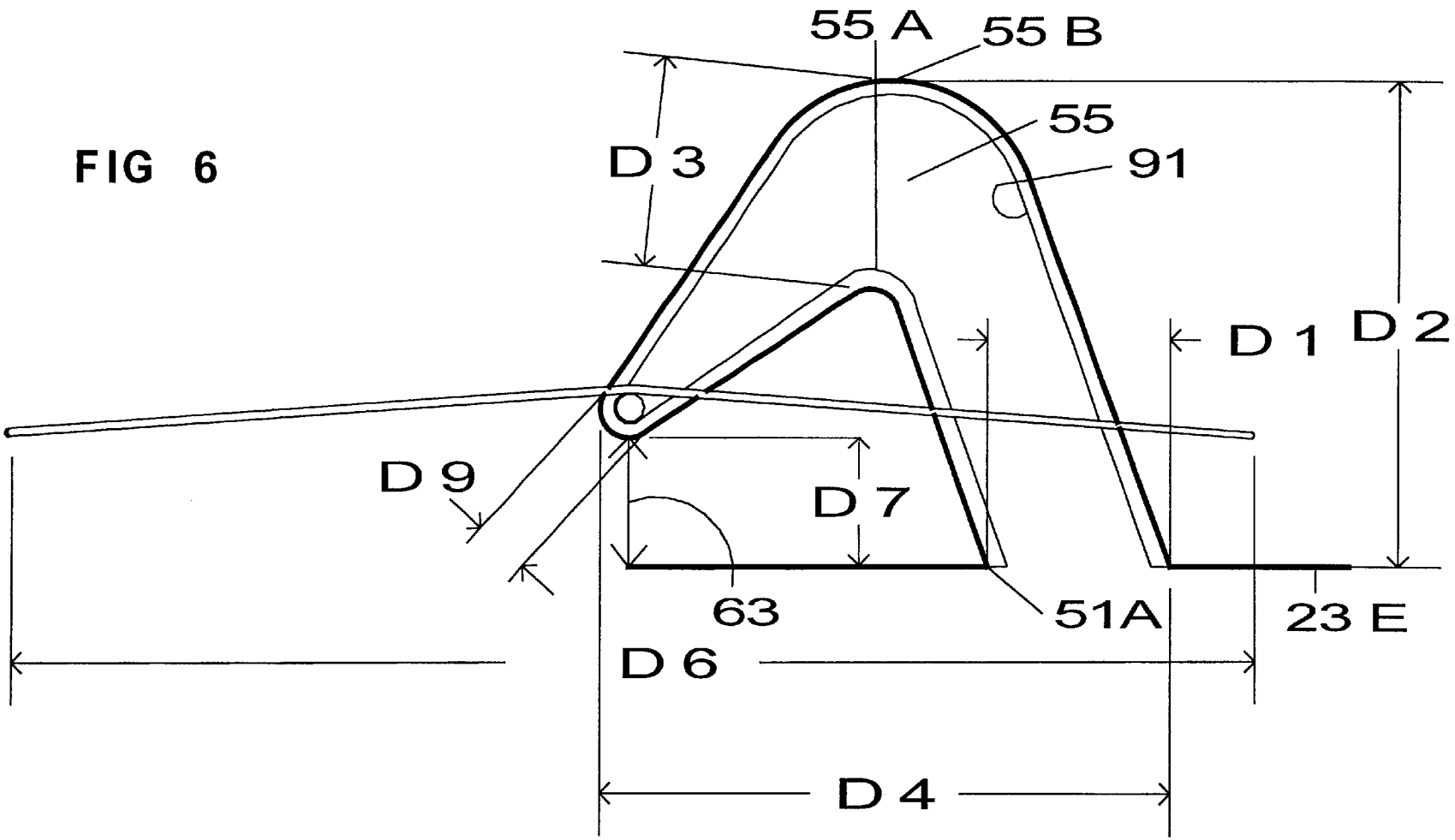
FIG. 6 is a top plan view of one of the slots of the rack of the invention with an elastomer cushion lining the wall of the slot.

The member 23, 25, 27, and 29 of the rack 21 may be formed of wood, plastic or metal. Member 91 shown in FIG. 6 is a flexible or elastic cushion made for example from an elastomer.

The rod is centered in both aperture 41 and slot 61 to prevent warpage. For fishing rods and pool cues, the rods will have a larger diameter than shown in FIG. 4 at the level of the member 25E such that they will engage the inside wall of the apertures 41 to maintain the rods centered in apertures 41.

What is claimed is:

1. A rack for holding an elongated rod, comprising:

a frame movable to different positions and comprising first and second spaced apart members each having an edge located such that said edges of said first and second members face in the same direction, a slot formed in said second member from said edge of said second member, said slot having an entrance which leads to a closed end defining a receiving space with said closed end being spaced inward from said edge of said second member and located along a line from said edge of said second member which line is spaced laterally from said entrance such that said slot defines a path which has a bend between said entrance and said closed end with the shortest distance between said edge of said second member and said closed end being less than the shortest distance between said edge of said second member and said bend, an aperture formed through said first member at a position spaced inward of said edge of said first member in line with said receiving space defined by said closed end, said aperture being defined by a surface which completely surrounds said aperture, and an elastic cord extending along said second member which crosses said slot between said bend and said edge of said second member and which is located near said closed end to allow a portion of the rod to extend through said aperture and a portion of the rod to be located in said slot and moved around said bend to said closed end and held against said closed end by said cord to removably secure the rod in said aperture.

2. The rack of claim 1, wherein:

said slot from said entrance to said bend and from said bend to said closed end define two paths which form an acute angle relative to each other.

3. The rack of claim 1, wherein:

said slot has two spaced apart edges which extend from said edge of said second member to said closed end where said two edges merge to define said receiving space.

4. The rack of claim 3, wherein:

said two edges of said slot from said closed end to said bend are straight and define an angle of about 22.5 degrees.

5. The rack of claim 3, wherein:

said slot from said entrance to said bend and from said bend to said closed end define two paths which form an acute angle relative to each other.

6. The rack of claim 4, wherein:

said slot from said entrance to said bend and from said bend to said closed end define two paths which form an acute angle relative to each other.

7. The rack of claim 6, wherein:

said path from said entrance to said bend is generally straight and forms an acute angle relative to said edge of said second member.

8. The rack of claim 1, wherein:

the maximum dimension of said aperture is less than the distance between said receiving space and said entrance of said slot.

9. A rack for holding a plurality of elongated rods, comprising:

a frame movable to different positions and comprising first and second spaced apart members each having an edge located such that said edges of said first and second members face in the same direction, a plurality of spaced apart slots formed in said second member from said edge of said second member, each of said slots having an entrance which leads to a closed end defining a receiving space with said closed end being spaced inward from said edge of said second member and located along a line from said edge of said second member which line is spaced laterally from said entrance such that said slot defines a path which has a bend between said entrance and said closed end with the shortest distance between said edge of said second member and said closed end being less than the shortest distance between said edge of said second member and said bend, a plurality of spaced apart apertures formed through said first member at positions spaced inward of said edge of said first member with each of said apertures being separately in line with one of each of said receiving spaces, each of said apertures being completely surrounded by a separate surface, and an elastic cord extending along said second member which crosses each of said slots between its said bend and said edge of said second member and which is located near its said closed end to allow a portion of a rod to be located in one of said aperatures and a portion of the rod located in said slot associated with said one aperture and moved around said bend to said closed end and held against said closed end by said cord.

10. The rack of claim 9, wherein:

the maximum dimension of each of said apertures is less than the distance between said receiving space with which said each aperature is in line with and said entrance of said slot of said receiving space.

* * * * *